US006840066B2

(12) United States Patent
Dickerson

(10) Patent No.: US 6,840,066 B2
(45) Date of Patent: Jan. 11, 2005

(54) WEBBING REINFORCED WITH HIGH-PERFORMANCE POLYMERIC YARNS

(75) Inventor: Phillip Dickerson, High Point, NC (US)

(73) Assignee: Hickory Springs Manufacturing Company, Hickory, NC (US)

( * ) Notice: Subject to any disclaimer, the term of this patent is extended or adjusted under 35 U.S.C. 154(b) by 3 days.

(21) Appl. No.: 10/424,325

(22) Filed: Apr. 28, 2003

(65) Prior Publication Data

US 2004/0211225 A1 Oct. 28, 2004

(51) Int. Cl.[7] ..... D04B 21/16
(52) U.S. Cl. ..... 66/192; 66/195
(58) Field of Search ..... 66/169 R, 170, 66/190, 191, 192, 193, 194, 195, 198, 202; 442/304–306, 312–314

(56) References Cited

U.S. PATENT DOCUMENTS

| | | | | | |
|---|---|---|---|---|---|
| 3,806,959 | A | * | 4/1974 | Gross | 66/192 |
| 4,009,597 | A | | 3/1977 | Wall et al. | 66/193 |
| 4,067,210 | A | * | 1/1978 | Arons et al. | 66/202 |
| 4,168,340 | A | | 9/1979 | Buyssens et al. | 428/294 |
| 4,248,064 | A | * | 2/1981 | Odham | 66/192 |
| 4,433,493 | A | * | 2/1984 | Poisson | 66/195 |
| 4,733,545 | A | | 3/1988 | Weinle et al. | 66/202 |
| 4,818,316 | A | * | 4/1989 | Weinle et al. | 66/193 |
| 5,125,246 | A | * | 6/1992 | Shytles | 66/193 |
| 5,191,777 | A | * | 3/1993 | Schnegg | 66/195 |
| 5,433,991 | A | * | 7/1995 | Boyd et al. | 66/192 |
| 5,472,766 | A | * | 12/1995 | Siegel et al. | 66/192 |
| 5,522,240 | A | | 6/1996 | Wall et al. | 66/192 |
| D380,091 | S | | 6/1997 | Shea et al. | D5/3 |
| 5,843,542 | A | | 12/1998 | Brushafer et al. | 428/36.1 |
| 2002/0061692 | A1 | | 5/2002 | Steckmann et al. | 442/229 |

* cited by examiner

*Primary Examiner*—Danny Worrell
(74) *Attorney, Agent, or Firm*—Womble Carlyle Sandridge & Rice, PLLC; C. Robert Rhodes; Craig H. Popalis

(57) ABSTRACT

A reinforced webbing material is disclosed for use in furniture, bedding and the like. The webbing includes a flat knitted fabric comprised of conventional yarns such as polyester. Elastomeric yarns or cords may also be, but are not necessarily, integrally knitted into the fabric structure in a warpwise direction. One or more high-performance polymeric reinforcement yarns are integrally knitted into the fabric structure in a lengthwise direction. The reinforcement yarns may comprise aramid fibers, ultra high molecular weight polyethylene, or other suitable high tensile strength polymeric yarns. The reinforcement yarns and elastomeric cords combine with the knitted fabric to provide a substantially elastic webbing material having a finite amount of stretch that is limited by the high performance yarns.

21 Claims, 1 Drawing Sheet

WEBBING REINFORCED WITH HIGH-PERFORMANCE POLYMERIC YARNS

BACKGROUND

1. Field of the Invention

The invention relates to fabric webbings for furniture, bedding, and the like, and particularly to webbing comprising at least one high-performance polymeric reinforcement yarn.

2. Description of the Prior Art

It is common in the bedding and furniture industries to use webbing materials in mattresses, box springs, seats and the like. These elongated lengths of webbing materials typically are a few inches wide, and typically are constructed of knit or woven synthetic filaments or yarns such as polyester or the like. These webbings typically have at least limited stretch even without elastic yarns. Elastomeric yarns are sometimes included in the constructions of such webbings to provide a desired amount of strength and resiliency. Such webbings may be used as part of a coil-spring foundation, in a mattress or box spring, for a cushion support, or in similar applications. In these applications, a matrix of pre-stretched webbings at least partially restrain and support a plurality of pre-compressed coil springs in a distributed pattern within a support frame. Arrays of such webbings may also be used to form a direct support for a cushion or the like.

The tensile, elastic, and elongation properties of webbings used in such bedding and furniture constructions are a factor in defining the overall firmness of the underlying supports as well as the responsiveness of such systems to applied loads. Highly-elastic webbings may provide a "spongy" feel, and may have insufficient strength to be useful in supporting a cushion, to restrain coiled springs in a desired pre-compressed state, or to adequately resist or withstand applied loads. Webbings that have high tensile strengths may be relatively inelastic, but may be capable of resisting and withstanding high load conditions and adequately restraining pre-compressed coil springs in a desired arrangement. Such webbings may not have sufficient resiliency, however, to provide a desired "feel" and responsiveness to applied loads.

Therefore, there is a need for a webbing material that provides a combination of high tensile strength and resilient responsiveness to applied loads.

SUMMARY OF THE INVENTION

A reinforced elastic webbing material is disclosed. The webbing material has a high tensile strength, and resiliently responds to applied loads. Reinforcement yarns limit the overall elongation of the webbing material. The flat knitted fabric is comprised of a plurality of warp yarns and a plurality of weft yarns at least partially interlaced together to form a substantially flat knitted fabric having first and second lateral edges. Such a construction will have some stretch. The fabric may also include elastomeric warp yarns to provide added resiliency to the webbing material. Such a fabric will stretch under load, and will tend to return to its original unstretched configuration. Longitudinal reinforcement is provided in the webbing by one or more polymeric reinforcement yarns that are at least partially interwoven in the knitted fabric. The reinforcement yarns are high-performance polymeric yarns having high strength-to-weight ratios (high tensile strength). These yarns act to limit the overall stretch of the webbing. The polymeric reinforcement yarns may be constructed of aramid fibers (e.g. Kevlar®, Twaron®, Technora®, or Monsanto X-500) or fibers comprising Ultra High Molecular Weight Polyethylene ("UHMWPE") (e.g. Spectra®, Dyneema®, or Tekmilon™). Other "high performance" yarns may be used.

The combination of the polymeric reinforcement yarns and the elastomeric members provides the knitted webbing material with a unique balance of strength and elastic responsiveness to applied loads. The polymeric reinforcement yarns and elastomeric members are integrally knitted into the knitted fabric structure so that they interact together in the webbing when the webbing is subjected to longitudinal or transverse loads. The reinforcement yarns limit the overall elongation of the webbing material under load, while the substantially elastic elastomeric yarns provide a resilient response to the applied loads.

The at least partially interlaced warp, filler, and weft yarns may be knitted together in a flat kit pattern such as by warp knitting. In one embodiment, the interlaced warp and weft yarns are polyester yarns, and may be a combination of two types of two-ply textured polyester yarns. At least one of the reinforcement yarns should be at least partially interwoven in a substantially lengthwise direction in the knitted fabric. Preferably a first polymeric reinforcement yarn is inlaid along a path proximate to a first lateral edge, and at least one other polymeric reinforcement yarn is inlaid lengthwise in the knitted fabric along a path proximate to the second lateral edge. These reinforcement yarns along the edges of the webbing material help to ensure that applied tensile loads are distributed substantially uniformly across the full width of the webbing material. There may be additional reinforcement yarns extending longitudinally or even transversely of the webbing.

This reinforced webbing material is useful for constructing foundations for bedding, seats and the like where a balance between strength and resilient responsiveness is required. Lengths of the webbing material may be pre-stretched across a bedding or furniture frame to provide a high-strength, semi-elastic support for cushions, coil springs, or the like. A more complete description of the webbing material may be understood from a reading of the following detailed description together with the drawings.

DETAILED DESCRIPTION

Figure 1:
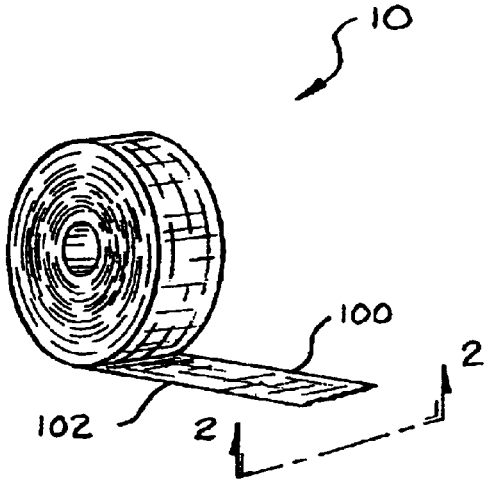
FIG. 1 is a perspective view of a roll of webbing material according to the invention.

As shown in FIG. 1, the invention provides an elongated strip of webbing material 10 that may be used in bedding, furniture, or other applications requiring a webbing material having a desirable degree of elastic or semi-elastic responsiveness under applied loads that do not exceed prescribed limits. The webbing material 10 may be provided in substantially any desired width. A typical range of widths for the webbing material 10 is about 1–6 inches, and a width of about 6 inches works well for many applications. The webbing material 10 may have a thickness of about 0.063 inch, but may be thinner or thicker depending on the desired physical properties for the reinforced webbing and the construction of the knitted fabric.

Figure 2:
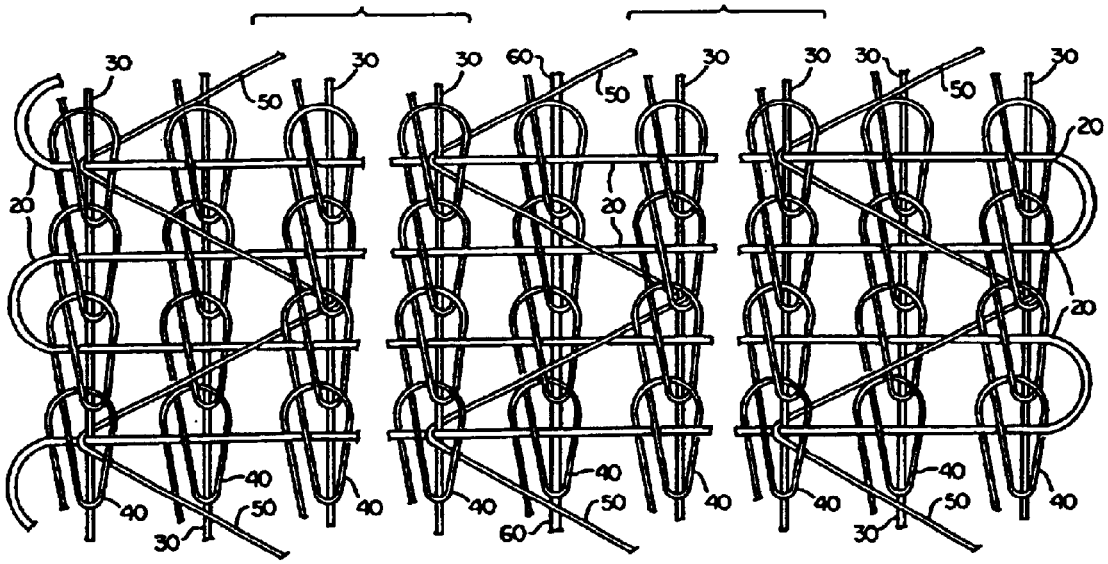
FIG. 2 is a detail plan view showing a knitted construction of one embodiment of a webbing material according to the invention taken along line 2—2 in FIG. 1.

As shown in FIG. 2, one embodiment 10 of the webbing material has a flat knitted construction. Alternatively, a similar woven construction can be used (not shown). A flat knitted construction like that shown in FIG. 2 can be produced on a conventional flat knitting machine.

One typical embodiment of the invention is shown in FIG. 2. A plurality of first conventional strength warp yarns 30, a plurality of second conventional strength warp yarns 40, and at least one conventional strength weft yarn 20 form the basic structure of webbing 10. In this embodiment, the first warp yarns 30 are 2-ply 300 denier textured polyester, the second warp yarn 40 is a 2-ply 150 denier textured polyester, and the weft yarn 20 is a 2-ply 300 denier textured polyester. Many other variations of conventional yarns are also envisioned.

Elastomeric warp members 60 are inlaid in the webbing in spaced, warpwise arrangement along the length of the webbing to impart additional elastic stiffness to the webbing. The elastomeric warp members 60 may be, but are not necessarily, comprised of an elastomeric material such as DuPont Hytrel®(a thermoplastic polyester elastomer), extruded rubber, or the like. In the illustrated embodiment, the elastomeric warp members 60 are 2350 denier monofilament Hytrel® elastomeric cords. In a typical six-inch wide webbing, about fifty of these elastomeric warp yarns, cords, or filaments 60 may be used. More or fewer elastomeric warp members 60 may be incorporated into the webbing 10 depending on the desired strength and the desired degree of stiffness and stretch for the webbing 10.

Also as shown in FIG. 2, high-performance polymeric reinforcing yarns 50 are integrated into the knitted structure in a substantially warpwise or lengthwise direction to impart desired longitudinal tensile and elastic properties to the webbing 10. The term "high-performance polymeric reinforcing yarn" as used herein refers to multi-ply yarns or filaments substantially comprised of polymeric materials having a tensile strength of at least about 400,000 lb/in$^2$. In this embodiment, the first warp yarns 30 are bound to the weft yarn 20 by interlaced loops formed by the second warp yarns 40. In addition, high performance reinforcing yarns may be introduced into the weft if lateral reinforcement is desired.

In the embodiment shown in FIG. 2, the reinforcing yarns are interlaced in a zigzag pattern. As shown, each reinforcement yarn 50 may be interlaced between non-adjacent warp yarns 30 to form a zigzag pattern. This zigzag pattern permits the webbing 10 to at least partially stretch in a longitudinal direction. The configuration of the zigzag pattern determines the amount of permitted elongation or stretch of the webbing 10. The more the length of the high performance yarn exceeds the length of the relaxed webbing, the more the webbing 10 can stretch. The less the high performance yarn exceeds the webbing length, the less the webbing 10 can stretch. Though the polymeric reinforcing yarns 50 are exceptionally strong and tough, they are also flexible, and can be incorporated into the webbing structure on a standard knitting machine. The reinforcing yarns are preferably 100–700 denier multi-ply yarns comprising aramid fibers (e.g. Kevlar® yarns). The reinforcing yarns preferably have a yield strength of at least about 400,000 ib/in$^2$. Other high-performance polymeric yarns having different deniers and compositions may also be used to impart desired tensile and elastic properties to the webbing. For example, Ultra High Molecular Weight Polyethylene ("UHMWPE") yarns (e.g. Spectra®) may be used.

In a typical 6-inch wide webbing construction, about ten polymeric reinforcing yarns 50 are interlaced in spaced, lengthwise arrangement in the knitted material. In this embodiment, one reinforcement yarn 50 is inlaid proximate to one lateral edge 100 of the webbing 10, and a second reinforcement yarn 50 is inlaid proximate to an opposite lateral edge 102 of the webbing. The balance of reinforcement yarns 50 are distributed in spaced arrangement between the lateral edges 100, 102 at equal or unequal spaced intervals. More or fewer reinforcement yarns may be used to impart the desired properties to the webbing 10.

The reinforcement yarns 50 impart enhanced tensile strength to the webbing 10 and control the elongation of the webbing 10 without eliminating the elastic properties of the webbing. Webbing 10 constructed as described above typically exhibits elongation in a range between about 1 percent and about 20 percent.

Optionally, a heat fusible binder yarn (not shown) may be integrated into the knitted fabric as, for example, an additional weft yarn. The webbing can be sufficiently heated after knitting to soften and fuse the heat fusible binder yarn to the other yarns and other component members.

The various embodiments disclosed herein are provided for the purpose of explanation and example only, and are not intended to limit the scope of the appended claims. Those of ordinary skill in the art will recognize that certain modifications can be made to the described embodiments without departing from the scope of the invention. For example, though aramid or UHMWPE reinforcement yarns 50 are desirable because they exhibit a high strength-to-diameter ratio, other high performance yarn materials exhibiting comparable qualities or properties also may be used. In addition, by way of example, other compositions and weights of yarns 20, 30, 40 other than those specifically described above may be used. Such modifications are within the scope of the claims appended hereto.

What is claimed is:

1. A reinforced webbing material comprising:

(a) a plurality of conventional strength warp yarns and at least one conventional strength weft yarn at least partially interlaced together to form a substantially flat knitted fabric having first and second lateral edges; and (b) at least one high-performance polymeric reinforcement yarn at least partially interwoven with at least a portion of the warp and weft yarns and extending in a substantially warpwise direction in the knitted fabric, the high-performance polymeric reinforcement yarn substantially comprising a polymeric material having a tensile strength of at least about 400,000 lb/in$^2$.

2. A reinforced webbing material according to claim 1 wherein the high-performance polymeric reinforcement yarns comprise aramid fibers.

3. A reinforced webbing material according to claim 1 wherein the high-performance polymeric reinforcement yarns comprise ultra high molecular weight polyethylene.

4. A reinforced webbing material according to claim 1 wherein the high-performance polymeric reinforcement yarns are between about 100 denier and about 700 denier.

5. A reinforced webbing material according to claim 1 wherein the high-performance polymeric reinforcement yarns are at least partially interwoven with at least a portion of the warp and weft yarns in a substantially zigzag pattern.

6. A reinforced webbing material according to claim 1 wherein at least one of the high-performance polymeric reinforcement yarns is at least partially interwoven in the knitted fabric proximate to the first lateral edge, and at least one other high-performance polymeric reinforcement yarn is at least partially interwoven in the knitted fabric proximate to the second lateral edge.

7. A reinforced webbing material according to claim 1 and further comprising a plurality of substantially straight elastomeric yarns, filaments, or cords inlaid lengthwise in the knitted fabric.

8. A reinforced webbing material according to claim 1 wherein the at least partially interlaced warp and weft yarns are interlaced in a warp knit pattern.

9. A reinforced webbing material according to claim 1 wherein the conventional strength warp and weft yarns comprise polyester yarns.

10. A reinforced webbing material according to claim 9 wherein the conventional strength warp and weft yarns comprise two-ply polyester yarns.

11. A reinforced webbing material according to claim 10 wherein the two-ply polyester yarns are textured.

12. A reinforced webbing material according to claim 1 further comprising at least one heat fusible binder yarn in the substantially flat knitted fabric.

13. A webbing material comprising:

(a) a knitted fabric structure having first and second lateral edges and comprising:
  (i) a plurality of first conventional strength warp yarns;
  (ii) a plurality of second conventional strength warp yarns; and
  (iii) a plurality of first conventional strength weft yarns;

(b) a plurality of elastomeric warp yarns, filaments, or cords integrally knitted into the knitted fabric structure; and (c) a plurality of high-performance polymeric yarns integrally knitted into the knitted fabric structure; wherein the plurality of elastomeric yarns, filaments, or cords and the plurality of high-performance polymeric yarns extend in a substantially warpwise direction.

14. A webbing material according to claim 13 wherein the high-performance polymeric yarns comprise aramid fibers having a denier in the range of 100–700.

15. A webbing material according to claim 13 wherein the high-performance polymeric yarns comprise ultra high molecular weight polyethylene having a denier in the range of 100–700.

16. A webbing material according to claim 13 wherein the first warp yarns, the second warp yarns, and the first weft yarns comprise two-ply polyester having deniers in the range of 150–300.

17. A webbing material according to claim 13 wherein the elastomeric warp yarns comprise a thermoplastic polyester elastomer.

18. A webbing material according to claim 13 wherein at least one of the high-performance polymeric yarns is integrally knitted into the knitted fabric structure proximate to the first lateral edge; and at least one other high-performance polymeric yarn is integrally knitted into the knitted fabric structure proximate to the second lateral edge.

19. A reinforced webbing material comprising a knitted fabric structure of at least partially interlaced substantially elastic yarns or filaments, a plurality of high-performance polymeric yarns integrally knitted lengthwise in the knitted fabric structure, and a plurality of substantially straight elastomeric yarns, filaments, or cords integrally knitted in the knitted fabric structure in a substantially warpwise direction, wherein the high-performance polymeric reinforcement yarns substantially comprise a polymeric material having a tensile strength of at least about 400,000 lb/in$^2$.

20. A reinforced webbing material according to claim 19 wherein the high-performance polymeric yarns comprise aramid fibers.

21. A reinforced webbing material according to claim 19 wherein the high-performance polymeric yarns comprise ultra high molecular weight polyethylene.

* * * * *